US011859456B2

(12) United States Patent
Zeghlache

(10) Patent No.: US 11,859,456 B2
(45) Date of Patent: Jan. 2, 2024

(54) CONTACTLESS CONVEYANCE FOR LOGGING WHILE LEVITATING (LWL)

(71) Applicant: SAUDI ARABIAN OIL COMPANY, Dhahran (SA)

(72) Inventor: Mohamed Larbi Zeghlache, Al Khobar (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 4 days.

(21) Appl. No.: 17/457,578

(22) Filed: Dec. 3, 2021

(65) Prior Publication Data

US 2023/0175329 A1 Jun. 8, 2023

(51) Int. Cl.

| | |
|---|---|
| ***E21B 44/00*** | (2006.01) |
| ***E21B 23/00*** | (2006.01) |
| ***E21B 47/12*** | (2012.01) |
| ***E21B 47/26*** | (2012.01) |

(52) U.S. Cl.

CPC ..... *E21B 23/001* (2020.05); *E21B 44/005* (2013.01); *E21B 47/12* (2013.01); *E21B 47/26* (2020.05)

(58) Field of Classification Search

CPC ..... E21B 23/001; E21B 47/26; E21B 44/005; E21B 47/12

See application file for complete search history.

(56) References Cited

U.S. PATENT DOCUMENTS

| | | | | |
|---|---|---|---|---|
| 6,378,627 | B1 | 4/2002 | Tubel et al. | |
| 6,843,317 | B2 | 1/2005 | Mackenzie | |
| 2006/0202685 | A1 | 9/2006 | Barolak et al. | |
| 2015/0354301 | A1 | 12/2015 | Al Dabbous | |
| 2016/0369620 | A1* | 12/2016 | Pelletier | G01V 1/40 |
| 2020/0240263 | A1* | 7/2020 | Sherrit | E21B 49/08 |
| 2020/0392803 | A1 | 12/2020 | Zhao et al. | |
| 2021/0054728 | A1* | 2/2021 | Fellinghaug | E21B 47/16 |
| 2021/0381369 | A1* | 12/2021 | Jackson | E21B 49/00 |

FOREIGN PATENT DOCUMENTS

| | | | |
|---|---|---|---|
| CN | 103590809 | A | 2/2014 |

OTHER PUBLICATIONS

Notification of Transmittal of the International Search Report and the Written Opinion of the International Searching Authority issued in corresponding International Application No. PCT/US2022/051709, dated Mar. 27, 2023 (13 pages).

* cited by examiner

*Primary Examiner* — Taras P Bemko

(74) *Attorney, Agent, or Firm* — Osha Bergman Watanabe & Burton LLP

(57) ABSTRACT

A method for logging in a cased well is disclosed. The method includes receiving well data comprising an orientation of the cased well, selecting a logging while levitating (LWL) assembly type based on the well data, running the LWL assembly into the well to a start depth, and activating the LWL assembly based on a downhole condition so that the LWL assembly levitates in a center of the cased well, wherein the activated LWL assembly moves downhole in the cased well while levitating. The method further includes determining whether the LWL assembly has reached a target depth and performing logging in the cased well while the LWL assembly is levitating in the cased well when the target depth is reached.

16 Claims, 8 Drawing Sheets

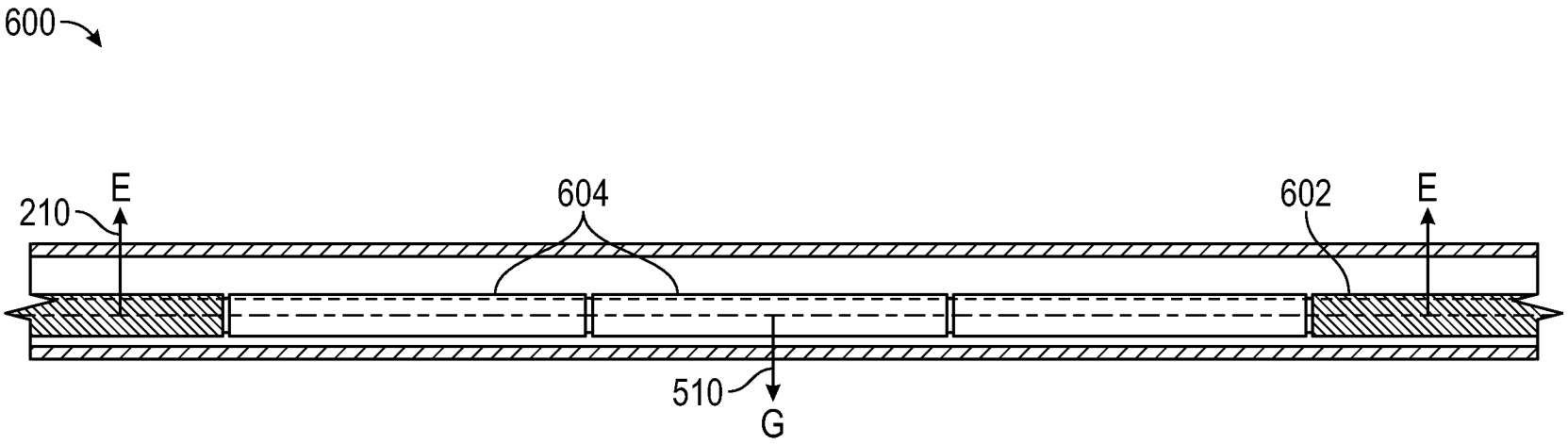
FIG. 6A
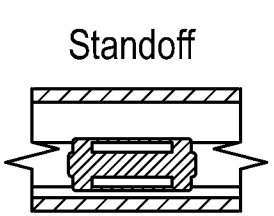
FIG. 6B
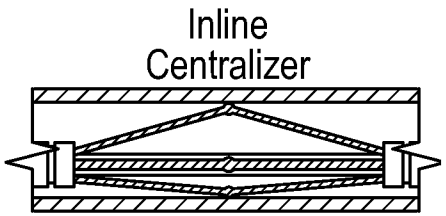
FIG. 6C
FIG. 6D
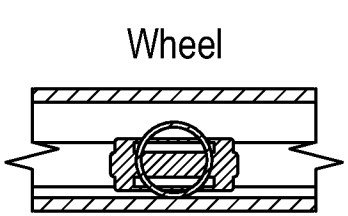
FIG. 6E

CONTACTLESS CONVEYANCE FOR LOGGING WHILE LEVITATING (LWL)

BACKGROUND

In the oil and gas industry, logging refers to the assessment of formation properties through the use of tools attached to a bottomhole assembly. Logging may be performed during the drilling of the well, as well as during the production and intervention stages. As such, logging may be performed in both an open-hole environment and a cased-hole environment. Logging is typically performed via one or more tools, which are directed down a wellbore by a conveyance method. Depending on the complexity of the well profile for downhole application or pipeline installation for surface application, many conveyance techniques exist to overcome challenges related to operation, safety, quality, and cost. In oil and gas wells, the choice of a given conveyance technique depends on many parameters, which may include well condition, borehole size, total depth, well profile, deviation, dog-leg severity, restriction, and completion, in addition to other unmentioned methods. Additionally, the required logging or intervention equipment to be run in the well and whether data is needed to stream in real-time or in memory mode can also influence the selection of a conveyance method.

Conveyance methods can be classified as tethered or untethered. Tethered conveyance may refer to all methods that provide direct mechanical connection or electrical connection or both to the logging and intervention tools from the surface equipment. Untethered conveyance refers to methods of transporting logging tools downhole without means for a mechanical or electrical connection to the surface equipment.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a method for logging in a cased well. The method includes receiving well data comprising an orientation of the cased well, selecting a logging while levitating (LWL) assembly type based on the well data, running the LWL assembly into the well to a start depth, and activating the LWL assembly based on a downhole condition so that the LWL assembly levitates in a center of the cased well, wherein the activated LWL assembly moves downhole in the cased well while levitating. The method further includes determining whether the LWL assembly has reached a target depth and performing logging in the cased well while the LWL assembly is levitating in the cased well when the target depth is reached.

In another aspect, embodiments disclosed herein relate to an assembly for logging in a cased well. The apparatus may include an electromagnet and at least one proximity sensor. The assembly is configured to levitate in a center of the cased well via an electromagnetic force applied by the electromagnet, and the assembly is configured to perform logging while levitating in the cased well.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The size and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

FIGS. 6A-6E show examples in accordance with one or more embodiments.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Embodiments disclosed herein relate to performing logging while having the logging tool levitating in a cased wellbore. The objective of embodiments disclosed herein is to introduce a simpler and a cost effective solution to replace complex hardware required for horizontal and extended reach drilling well conveyance while improving sensor position in the wellbore. The solution discussed herein is tailored for both tethered and untethered conveyance options, and applies to surface pipelines and cased-hole wells with ferromagnetic pipes.

Figure 1:
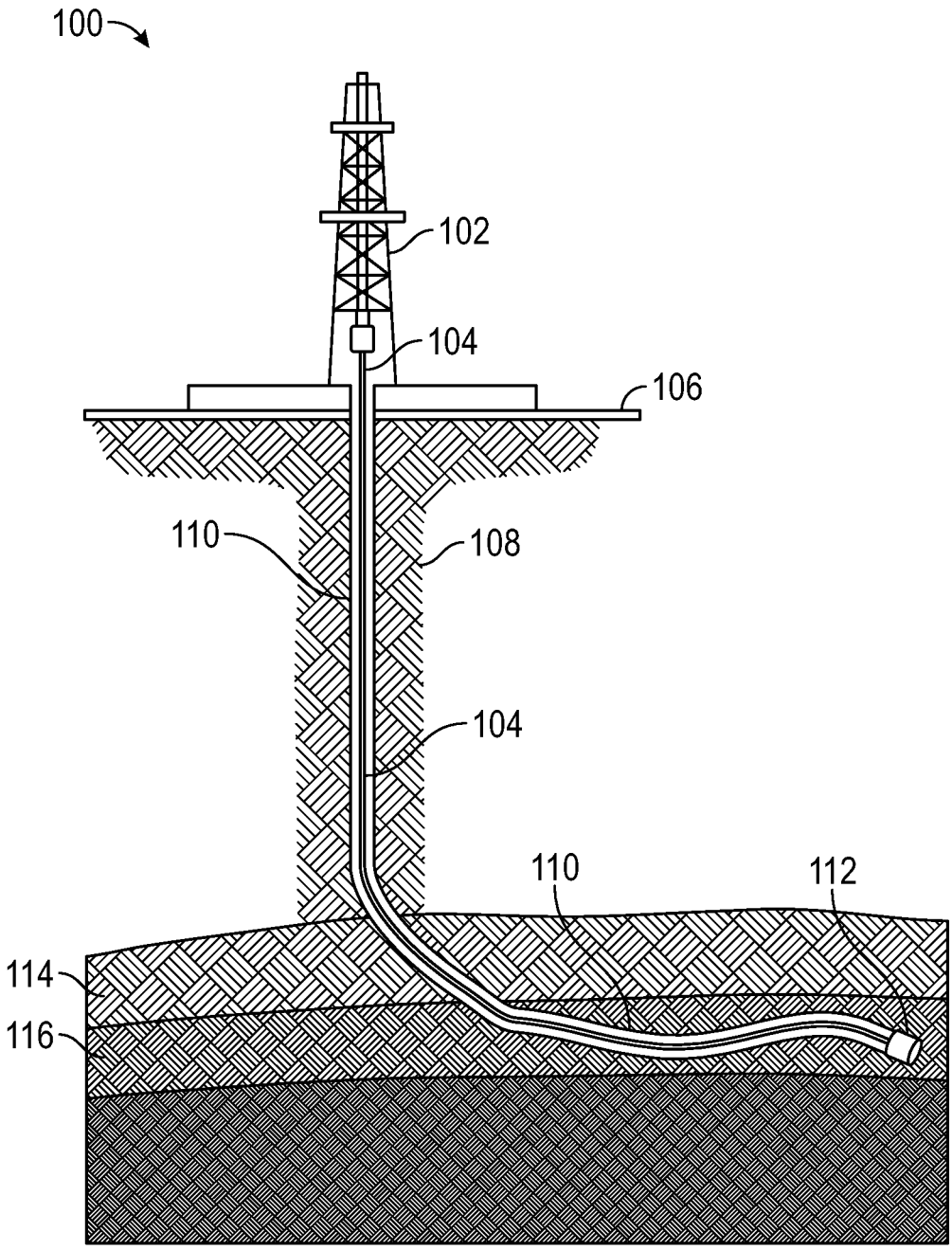
FIG. 1 shows an exemplary production system in accordance with one or more embodiments.

FIG. 1 illustrates an exemplary well (100) in accordance with one or more embodiments. As shown in FIG. 1, a well path (110) may be drilled by a drill bit (112) attached by a drill string (104) to a drill rig (102) located on the surface of the earth (106). The well may traverse a plurality of overburden layers (108) and one or more cap-rock layers (114) to a hydrocarbon reservoir (116). The well path (110) may be a curved well path, or a straight well path. In one or more embodiments, the well path (110) may be described as vertical, deviated, horizontal, or extended reach drilling (ERD). One skilled in the art will be aware that deviated, horizontal, and ERD wells are considered to be complex.

In one or more embodiments, logging, with the aid of conveyance methods, may be performed in the exemplary well (100). Typical logging operations are conducted during open hole drilling operations or if the well has open hole completion. However, logging may also occur in cased-hole wells, particularly in the production and intervention stages. For example, logging for the purpose of cement evaluation is conducted in a cased-hole environment. Further, some open hole wells also have cased-hole sections. The purpose of conveyance methods is to provide a safe and efficient way to take logging and intervention tools to a target depth, which, in some embodiments, may be a total depth. References to total depth herein may refer to the depth at which drilling is stopped, and therefore the depth of the bottom of the wellbore. For vertical wells, it is straightforward to use any type of line as a conveyance method. For example, a line may refer to wireline, slickline, or fiberline. However, the definition herein of a line is not meant to be limiting and a line may refer to any method of mechanically or electrically connecting a logging apparatus to the surface equipment of a well. As well complexity increases, the required equipment and procedure for conveyance becomes inherently more costly and complicated, with two particular challenges being lock-depth due to high drag and friction, and sensor position that is biased by the weight of the tools and conveyance system. Embodiments disclosed herein provide for a solution for logging operations in complex wells where both challenges are addressed and overcome simultaneously.

FIGS. 2A-2D show a variety of well orientations which may be drilled in one or more embodiments, and which may be integrated with a tethered conveyance method or an untethered conveyance method (not pictured). As noted above, tethered conveyance refers to all methods that provide direct mechanical and/or electrical connection to the logging and intervention tools. For example, a wireline conveyance provides both mechanical and electrical connection with logging tools, on the other hand, memory logging with through bit or coiled tubing provides only mechanical connection to the logging tools. The untethered conveyance refers to the use of sensors mounted on autonomous robots (i.e., single use/deployment sensors or self-deployed sensors) where no physical connection with the surface is present.

Figures 2A, 2B, 2C, 2D:
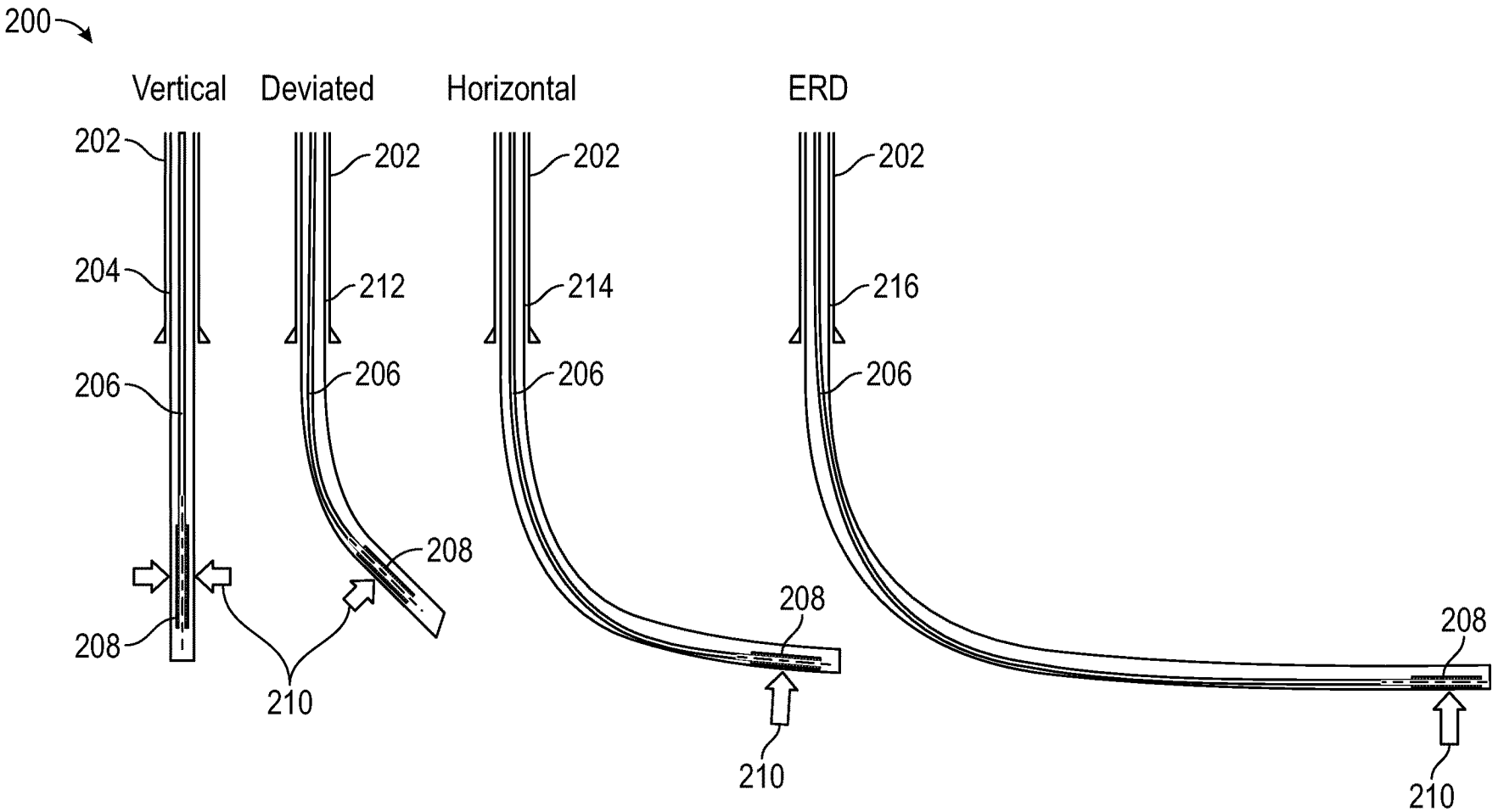
FIGS. 2A-2D show well orientations in accordance with one or more embodiments.

Turning first to FIG. 2A, FIG. 2A shows a casing (202), set in a vertical wellbore (204). In one or more embodiments, a logging while levitating (LWL) assembly (208) is shown connected to the drill rig (102) by a tether (206) and acts as a conveyance method for one or more logging tools. One skilled in the art would readily appreciate that there are many different types of logging tools which may be required for various operations. For example, an ultrasonic transducer may be required for corrosion inspection and cement evaluation. Further embodiments of the present disclosure may integrate with a tubing cutter or a power centralizer. Any suitable type of logging tool may be utilized with the LWL assembly (208) without departing from the scope of this disclosure.

In one or more embodiments, a levitation force (210) may be applied to the LWL assembly (208) to eliminate contact of the assembly with the wellbore (204), wherein the LWL assembly is considered to 'levitate' in the center of the wellbore (204) or as close to the center as possible. The assembly is said to levitate because it is contactlessly deployed in the center of a cased wellbore. FIG. 2B shows the LWL assembly (208) disposed within a deviated wellbore (212). It will be known to one skilled in the art that a deviated wellbore (212) is one which is typically intentionally drilled away from vertical. FIG. 2C depicts the LWL assembly (208) disposed within a horizontal wellbore (214). FIG. 2D shows the LWL assembly (208) disposed within an extended reach drilling (ERD) wellbore (216). It will be apparent to one skilled in the art that an ERD wellbore (216) extends further horizontally than it does vertically. Although FIGS. 2A-2D illustrate specific well orientations, embodiments of the present disclosure may be implemented in a variety of well orientations without sacrificing functionality or performance.

Standard conveyance methods may be integrated with a tethered LWL assembly (208). In vertical wellbores (204), the tether (206) may be a wireline, or any other type of line typically used to connect downhole tools to the surface equipment. In deviated wellbores (212) or horizontal wellbores (214), the tether (206) may comprise drill pipe and coil tubing. In ERD wellbores (216), the tether may comprise a combination of wireline, tractors, and wheeled carriages.

In tethered conveyance methods, one or more embodiments of the present disclosure eliminate drag and friction on the logging tools and accessories by providing a levitation force (210) that will lift or push the LWL assembly (208) and any attached logging tools into the center of the wellbore (204) or as close to the center of the wellbore as possible. Ideally, the logging tool center is pushed to the well center or as close to the well center as possible. In some embodiments, pushing the logging tool center may involve lifting or elevating the tool center, especially for deviated and horizontal well sections. In some embodiments, it may not be required to elevate the whole tool string. In such embodiments, mechanical decoupling is required to isolate the section of the wellbore (204) where the LWL assembly (208) will be utilized. Mechanical decoupling may be achieved in a number of different ways. For example, the use of knuckle joints or flexible joints between tool string sections may allow for mechanical decoupling. This may permit selective levitation for specific sections of a tool string as needed or planned.

In some embodiments, there may be one levitation force (210) applied to the LWL assembly (208) in order to maintain its central location in the wellbore (204). There may also be some embodiments wherein more than one levitation force (210) is applied to the LWL assembly (208) in order to maintain its central location in the wellbore (204).

Figure 3A:
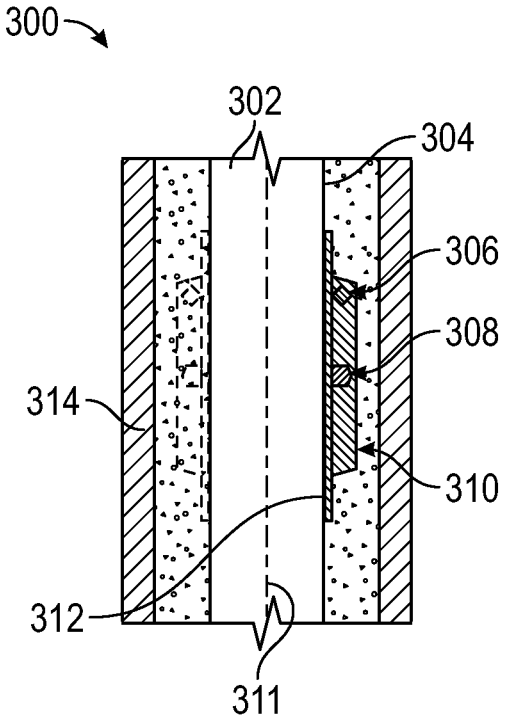
FIGS. 3A-3C show examples in accordance with one or more embodiments.
Figure 3B:
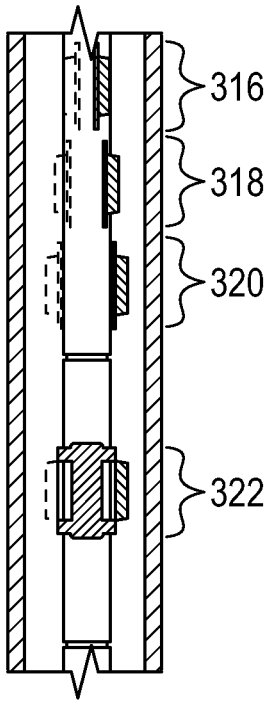
Figure 3C:
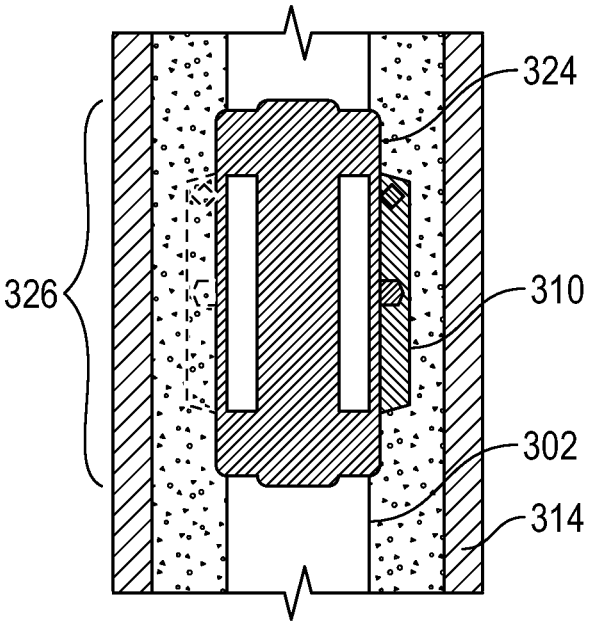

FIGS. 3A-3C show examples of a LWL assembly (208) that is used to facilitate contactless deployment of tethered sensors in a vertical wellbore (204). More specifically, FIG. 3A shows an example of a LWL assembly (208), which comprises an electromagnet (310) connected to a tool body (302). Some embodiments may have one or more tilt sensors (306) mounted upon the electromagnet (310), though there may be embodiments that do not include tilt sensors (306). One or more proximity sensors (308) may be attached to the electromagnet (310). In embodiments where the LWL assembly (208) possesses more than one proximity sensor (308), a tilt sensor (306) may be optional. A levitation force (210) may be produced as a result of the interaction of the electromagnet (310) with a ferromagnetic casing (314), which may be disposed within the wellbore (204). In some embodiments, there may be two electromagnets (310) attached to a tool body (302) to produce two levitation forces (210) that act to center the LWL assembly (208) in the wellbore (204).

FIG. 3B depicts the versatility of the LWL assembly (208) in terms of how such an assembly may be positioned relative to a tool body (302). In one or more embodiments, the LWL assembly (208) may be an intra-body assembly (316), wherein the components of the LWL assembly (208) are included within the tool body (302). In other embodiments, the LWL assembly (208) may be an inter-body assembly (318), wherein the components of the LWL assembly (208) are embedded into the tool body (302), such that one part of the LWL assembly (208) is located on the interior of the tool body (302) and another part of the LWL assembly (208) is located exterior to the tool body (302). In further embodiments, the LWL assembly (208) may be an over-body assembly (320), wherein the LWL assembly (208) may be fitted around the tool body (302), such that an interior surface of the electromagnet (312) is flush with the exterior surface of the tool body (304), as shown in the example of FIG. 3A.

In one or more embodiments, any of the intra-body assembly (316), inter-body assembly (318), or over-body assembly (320) may be employed where there are two electromagnets (310), complete with attached sensors, which may include tilt sensors (306) and/or proximity sensors (308). In these cases, the electromagnets (310) are positioned in a parallel fashion about a tool center (311), and the interior surfaces of the electromagnets (312) are flush with the exterior surfaces of the tool body (304).

Further, additional tool accessories may be combined with the tool body (302) and the LWL assembly (208), forming a LWL apparatus (326), of which one embodiment is shown in FIG. 3C. In some embodiments, such a combination may be an assembled over-body tool (322), where an over-body LWL assembly (320) is attached to the tool body (302) in conjunction with an accessory, of which there are many embodiments, to optimally achieve logging. Alternatively, in one or more embodiments, the LWL assembly may be a standalone LWL sub without any accessories or tools attached or integrated therein (see FIG. 6 below).

More specifically, FIG. 3C shows a LWL assembly (208) which is integrated with a standoff (324). A standoff (324) is a type of tool accessory which may be attached to the tool body (302). One skilled in the art will readily appreciate that there are many types of tool accessories, and all such accessories may be integrated with the LWL assembly (208) without departing from the scope of this disclosure. In some embodiments, it may be desirable to use an accessory which utilizes electromagnetic sensors to complete logging. In such embodiments, an accessory shield (not pictured) may be connected to the LWL apparatus (326) to avoid causing interference via the use of the electromagnet (310) and ferromagnetic casing (314).

Figure 4A:
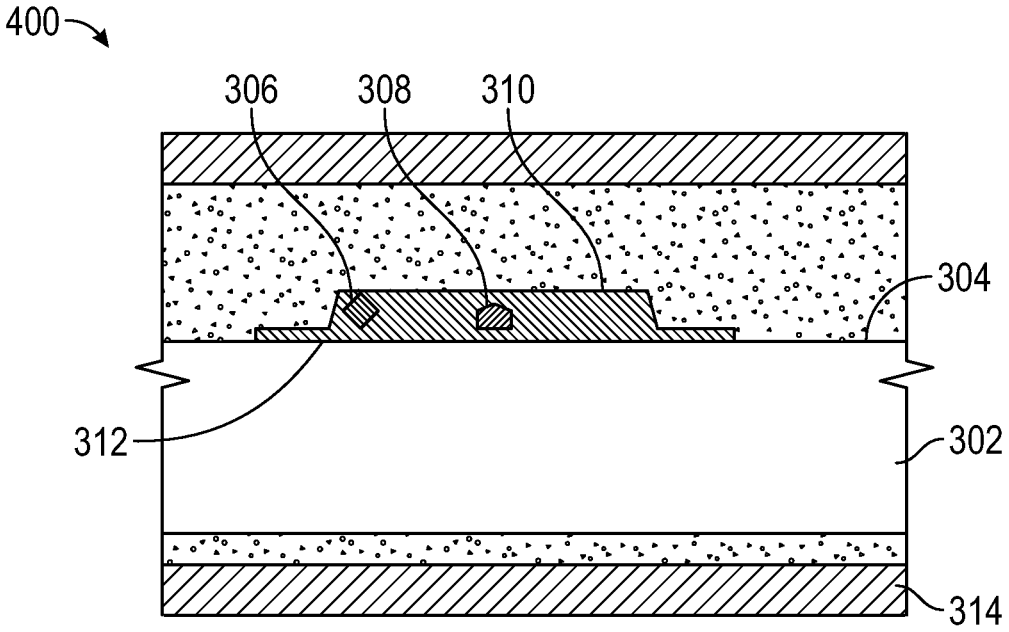
FIGS. 4A-4C show examples in accordance with one or more embodiments.
Figure 4B:
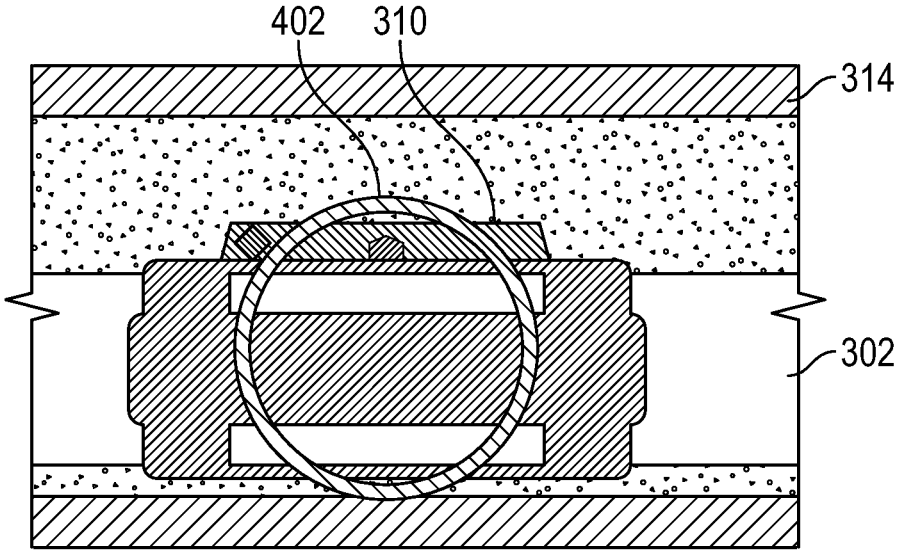
Figure 4C:
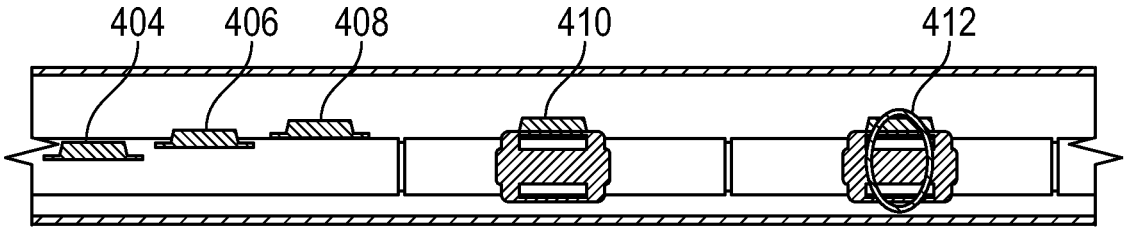

Turning now to FIGS. 4A-4C, FIGS. 4A-4C show examples of the implementation of a LWL assembly (208) in complex well orientations, including deviated wellbores (212), horizontal wellbores (214), and ERD wellbores (216). Similar to FIG. 3A, FIG. 4A shows a LWL assembly (208) integrated with a tool body (302). Converse to embodiments which are suited to vertical wellbores (204), embodiments intended for use in complex wellbores require only one electromagnet (310) for producing a sufficient levitation force (210) to allow a logging tool to traverse contactlessly within the wellbore casing. One or more proximity sensors (308) may be mounted on the electromagnet (310). In some embodiments, a tilt sensor (306) may also be fixed to the electromagnet (310).

Like in embodiments implemented in vertical wellbores (204), embodiments intended for use in complex wellbores may have integrated orienting accessories for optimal levitation. FIG. 4B illustrates a LWL assembly (208) which is integrated with an orienting wheel (402). The orienting wheel (402) is configured to orient the LWL assembly so that it stays as close to the center of the casing as possible and in order to guide the LWL assembly in traversing the wellbore to a predetermined or particular depth. In one or more embodiments, the wheel may be rounded or round shaped. The orienting wheel (402) may have at least two wheels which are connected to a housing via an axle, which may systematically push down the center of gravity of the LWL assembly (208) and tool string. The orienting wheel (402) may force the tool string to face a certain direction regardless of its initial position and movement. In some embodiments, the number of orienting wheels (402) and their respective location along the tool string may be optimized based on tool string configuration and downhole conditions. In embodiments where the LWL assembly (208) possesses more than one proximity sensor (308), tilt sensors (306) and orienting wheels (402) may be optional.

FIG. 4C depicts the versatility of the LWL assembly (208) in terms of how such an assembly may be positioned relative to a tool body (302) in complex well profiles. The positioning of the LWL assembly (208) does not change between vertical wellbores (204) and complex wellbores. Therefore, FIG. 4C may be considered to be analogous to FIG. 3B. Depending upon the needs of the desired logging operation, an intra-body assembly (404), inter-body assembly (406), or over-body assembly (408) may be used. Similar to use of an LWL assembly (208) in vertical wells, the LWL assembly (208) may be combined with an accessory in one or more embodiments. For example, an assembled over-body tool (410) may be created when an over-body LWL assembly (408) is attached to the tool body (302) in conjunction with an accessory.

For example, in one or more embodiments, an orienting wheel (402) may be combined with a LWL assembly (208) and a tool body (302) to form a LWL apparatus (412). In some embodiments, it may be desirable to use an accessory which utilizes electromagnetic sensors to complete logging. In such embodiments, an accessory shield (not pictured) may be connected to a LWL apparatus (412) to avoid causing interference via the use of the electromagnet (310) and ferromagnetic casing (314).

Figure 5:
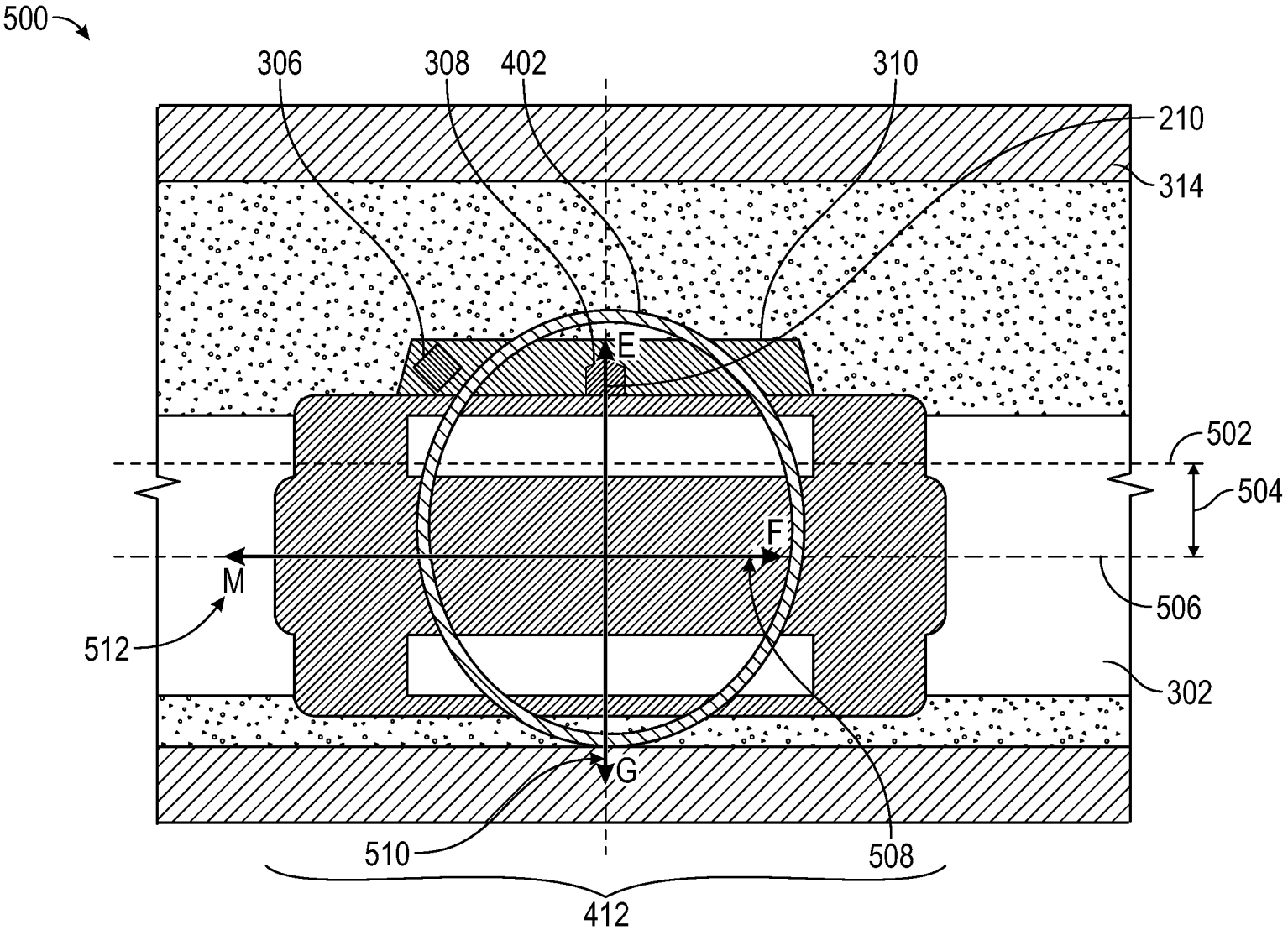
FIG. 5 shows an assembly in accordance with one or more embodiments.

FIG. 5 depicts an LWL apparatus (412) in an operative state in accordance with one or more embodiments. Embodiments of the present disclosure may be implemented in order to effectively levitate a downhole logging tool such that a tool center (506) is aligned with a well center (502). As shown in FIG. 5, eccentricity (504) refers to the distance between the tool center (506) and the well center (502). A successful implementation of a LWL assembly (208) eliminates the eccentricity (504) via the application of a levitation force (210), which acts to counteract a gravitational force (510). The gravitational force (510) may be produced by a combination of the weight of the LWL assembly (208) and the weight of any tools and accessories needed for logging operations. Elimination of eccentricity (504) may also eliminate contact between the LWL assembly and any accompanying tools or accessories with the ferromagnetic casing (314). Hence, a resultant frictional force (508) is reduced to fluid friction only when the LWL assembly (208) is operational. A running-in-hole force (512) acts in opposition to the resultant frictional force (508).

A successful deployment of a LWL assembly (208) requires satisfying a number of critical conditions. First, once well deviation exceeds a certain angle, the orientation of the LWL assembly (208) and any attached tools must be controlled and maintained in a specific direction. Controlling and maintaining a tool string in a specific direction, for example sensor side down, may allow the tool string to rotate such that it is forced in a given and constant direction. In some embodiments, this condition may be satisfied by offsetting the center of gravity of the tools. A levitation force may be oriented in opposition to weight and frictional forces, and the angle at which this is achieved may depend on well orientation. The angle may be determined during pre-job planning based on operation objectives and, as such, there is no minimum or maximum angle.

In other embodiments, orienting accessories, such as an orienting wheel (402), may be attached to the LWL assembly (208). Second, the levitation force (210), which may also be referred to as an electromagnetic force, must be automatically activated or deactivated in order to properly accomplish levitation. Such control of the levitation force may occur at the surface in some embodiments, or downhole in other embodiments. Third, the required levitation force may be calculated based on the weight of the LWL assembly and any accompanying tools, eccentricity, and buoyancy. Fourth, a proximity sensor (308), which monitors the distance between the proximity sensor (308) and the ferromagnetic casing (314), may be used to determine the position of the LWL assembly (208) within the wellbore and to control the levitation force (210).

FIG. 6A depicts a standalone LWL sub (602) integrated with a tool string (604). In addition to embodiments where the LWL assembly (208) is integrated with tools and accessories, there may be embodiments where a standalone LWL sub (602) is built and combined with any other tools to provide the same functionality as a LWL assembly (208) with higher levitation forces (210) and a modular configuration. In some embodiments, the standalone LWL sub (602) may refer to a combination of an electromagnet (310) and various sensors, which may include a tilt sensor (306) and/or a proximity sensor (308). In other embodiments, there may be additional tools or accessories combined with the electromagnet (310) and sensors. The standalone LWL sub (602) may be attached to a series of connected tool bodies (302), which may be referred to as a tool string (604). The standalone LWL subs (602) may be attached to each end of the tool string (604), or to other critical locations along the tool string (604). Levitation forces (210) may be applied to counteract the gravitational force (510). The use of standalone LWL subs (602) add flexibility and modularity to the tool string (604) and provide levitation to the entire tool string (604) in specific and critical locations along the tool string (604).

Commonly used accessories to offset or centralize tools in horizontal wellbores (214) are shown in FIGS. 6B-6E. FIG. 6B illustrates an over-body centralizer, which may be implemented over a tool body (302) to offset the tool body from the wall of the wellbore (214), which may be ferromagnetic casing (314). Likewise, an inline centralizer, as shown in FIG. 6C, may be implemented over a tool body (302) to offset the tool body from the wall of the wellbore (214). FIGS. 6D and 6E depict the use of a standoff (324) or an orienting wheel (402) without a LWL assembly (208) in attempts to centralize the tool string (604). While the techniques depicted in FIGS. 6B-6E do reduce surface contact area with the wellbore (214), there is still some contact and therefore drag and friction still exists. Conversely, the implementation of a LWL assembly (208) or a standalone LWL sub (602) achieves perfect centralization within the wellbore, eliminates drag and friction, and also allows for contactless deployment. Implementation of a LWL assembly (208) or a standalone LWL sub (602) may lower chocks, vibrations, and tool wear and tear.

Figure 7:
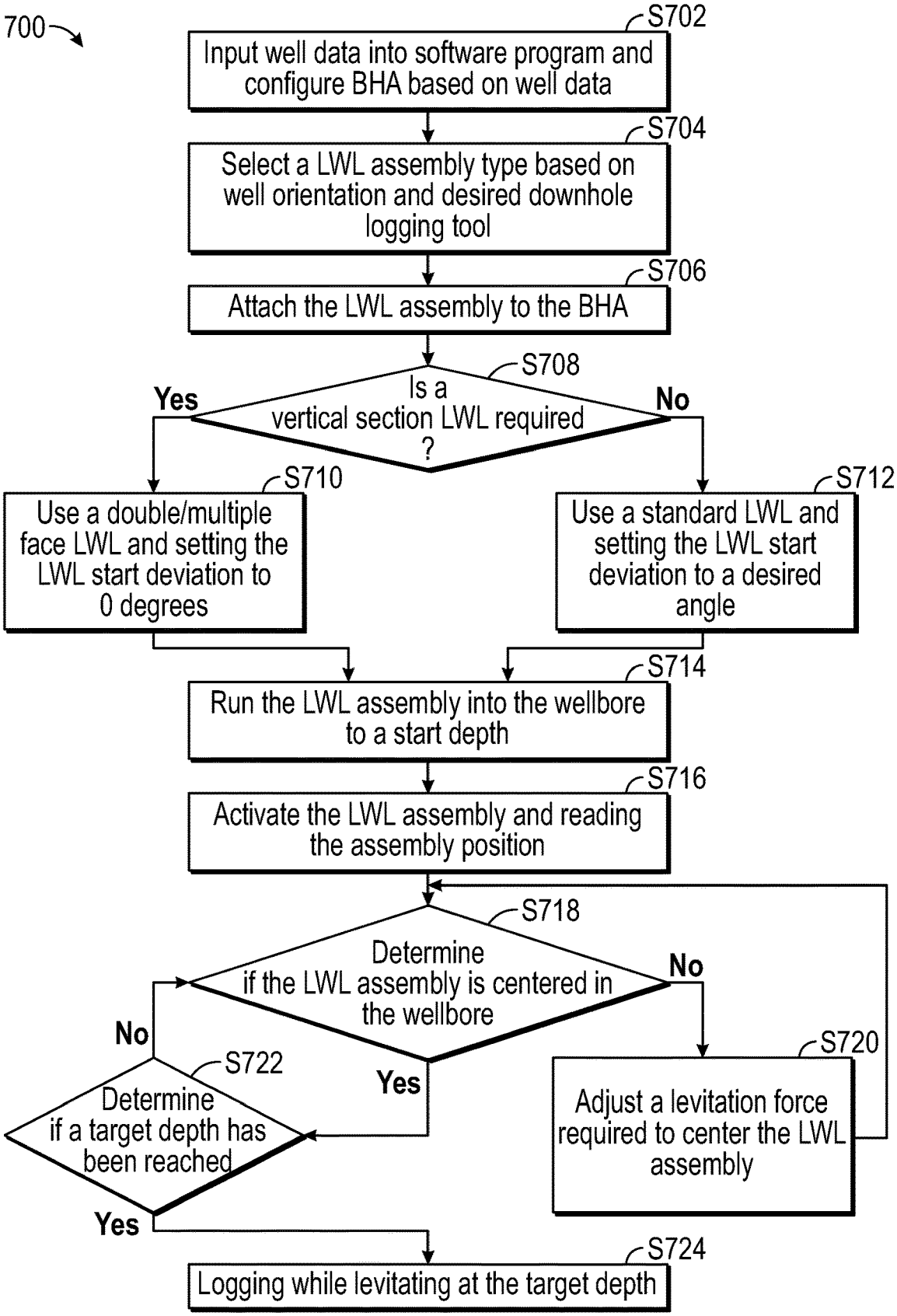
FIG. 7 shows a flowchart in accordance with one or more embodiments.

FIG. 7 shows a flowchart for a method of logging while levitating in accordance with one or more embodiments. More specifically, FIG. 7 depicts a method (700) for levitating a LWL assembly (208) and maintaining the LWL assembly's position in the center of a casing (202). FIG. 7 may apply to both tethered and untethered conveyance methods. Further, one or more blocks in FIG. 7 may be performed by one or more components as described in FIGS. 1-6E. While the various blocks in FIG. 7 are presented and described sequentially, one of ordinary skill in the art will appreciate that some or all of the blocks may be executed in different orders, may be combined, may be omitted, and some or all of the blocks may be executed in parallel. Furthermore, the blocks may be performed actively or passively.

Initially, well data is provided as input data to configure a bottomhole hole assembly (BHA) according to the input data (S702). For example, the well data may be input into a software program. The software program may be any simulation program executing on a computing device (e.g., computer, tablet, smart phone, gaming device, etc.) with a processor and memory (not shown), located on the surface, that is capable of selecting/designing a BHA based on well data. As used herein, the term well data may refer to information regarding the well's deviation, depth, borehole fluid density, pressure, temperature, and diameter (internal profile). While these properties are some examples of well data and the definition used herein, this list is not exhaustive and is not intended to be limiting. The scope of the definition of well data encompasses any information which describes the well, wellbore, or formation.

In one or more embodiments, a LWL assembly (208) type may be selected based on well orientation and the desired downhole logging tool (S704). In some embodiments, depending on the well data collected, it may be beneficial to select a LWL assembly (208) that is standalone, where the LWL assembly (208) is modified in order to add functionality of a desired downhole logging tool. In other embodiments, an integrated LWL assembly (208) may be desirable, wherein integrated refers to the combination of the LWL assembly (208) and a desired downhole logging tool. In further embodiments, an over-body LWL assembly (208) may be selected, wherein the LWL assembly (208) is fitted over the desired downhole logging tool.

In S706, a LWL assembly (208) may be attached to a bottomhole assembly. Attachment of the LWL assembly (208) to the bottomhole assembly may depend on the situation. For example, attachment may differ depending on if the LWL assembly (208) is mounted directly onto to the tool string or if an accessory is added to the tool string. The bottomhole assembly may be any type of bottomhole assembly utilized within well drilling without departing from the scope of this disclosure. Depending upon well orientation, a determination is made to as to whether a vertical section LWL assembly (208) is required (S708). If a vertical section LWL assembly (208) is required (YES), a double face or multiple face LWL assembly (208) is used, and a start deviation is set to 0° (S710). Start deviation may refer to the deviation value at which the LWL assembly (208) may be started/powered on. Due to predetermined knowledge or measurement of well profile, depth versus deviation, and azimuth, deviation may be used to control depth, and start deviation is dependent upon depth. A double face LWL assembly (208) may refer to a LWL assembly (208) which utilizes two levitation forces (210) to center the LWL assembly (208) within the wellbore (204). A multiple face LWL assembly (208) may refer to a LWL assembly (208) which utilizes a plurality of levitation forces (210) to center the LWL assembly (208) in the wellbore (204) and which may improve system stability.

If a vertical section LWL assembly (208) is not required (NO), a standard LWL assembly (208) is used and a start deviation is set to a desired angle, selected based on the deviation of the wellbore (212, 214, or 216) (S712). In some embodiments, a simulation software for lock depth may determine the depth at which the tool string will stop moving due to friction and increased deviations. In other embodiments, the start deviation angle may refer to the depth of the top logging interval, which is the depth at which data acquisition should begin and at which tool string position is critical for data quality. In further embodiments, the start deviation angle may be any other angle corresponding to a depth where the logging operation is required to start. In one or more embodiments, one angle may be seen at multiple depths, in S-shaped wells, for example. In such embodiments, the start deviation angle must be used as a reference to depth, not as its absolute value. In general, start deviation angle may refer to a reference point in the well trajectory at which the LWL assembly (208) is required to power on, and this point may be determined in any number of ways. Examples of methods of determining this reference point are measured depth, true vertical depth, deviation angle, and azimuth angle. However, this list is not exhaustive, and there may be other methods of determining this reference point which do not depart from the scope of this disclosure.

The LWL assembly (208) may be run into the wellbore (204) to a start depth, which may be selected based on user objectives, desired downhole logging tools, well conditions, or any other factor related to the goal of the downhole logging endeavor (S714). Once the desired start depth has been reached, the LWL assembly (208) may be activated and the LWL assembly (208) position in the wellbore (204) may be read (S716). Activation refers to the process by which the levitation of the LWL assembly is triggered. When the LWL assembly (208) is activated, it may begin levitating the tool string off the wellbore side to as close as possible to the center of the wellbore. In one or more embodiments, activation may be achieved by sending power from the surface to switch on the LWL assembly (208). In these embodiments, an operator may monitor tool string position from the surface and determine when to activate the LWL assembly (208) to ensure tool string position is as close to centered in the wellbore as possible. In other embodiments, a command may be sent from the surface to internal electronics to power on the LWL assembly (208). In further embodiments, parameters may be predefined in order for the LWL assembly to self-power from the surface or autonomously from an internal battery. In one or more embodiments, activation of the LWL assembly (208) may be triggered by a downhole condition. For example, in one or more embodiments, a particular depth, deviation, pressure, and/or temperature may trigger the activation of the LWL assembly (208). In other embodiments, a reading from a tilt sensor (306), or a reading deviation from other sensors present in the BHA, may trigger the activation of the LWL assembly (208). The LWL assembly may be supplied with power from the surface (106) in some embodiments, or from a downhole battery in other embodiments.

Once activated, the LWL assembly (208), via sensors, may determine if it is centered in the wellbore (204) (S718). For example, sensors may measure the eccentricity (504) or another distance to determine whether the LWL assembly is centered within the casing. If the LWL assembly (208) is not centered in the wellbore (204) (NO), the levitation force (210) may be adjusted in order to lift the LWL assembly (208) into the center of the wellbore (204) (S720). If the LWL assembly is centered (YES), then the process moves to S722.

There are many methods of determining and controlling tool position within the wellbore (204). In one or more embodiments, an intermittent magnetization force, controlled based on electromagnetic field strength, may be utilized to control tool position. Tool position may be based on the angle of the LWL assembly (208) and the distance from the LWL assembly (208) to the inner wall of the ferromagnetic casing (314). These parameters may be fixed or adjustable. In embodiments wherein fixed parameters are utilized, LWL assemblies (208) are preset to provide a fixed force, wherein a combination of a number of such forces produces the required levitation force (210). In embodiments where adjustable parameters are utilized, the angle and distance from the LWL assembly to the inner wall of the ferromagnetic casing (314) are continuously monitored to allow for instant and live adjustment of force. In some embodiments, this adjustment may be made manually. In other embodiments, this adjustment may be made using a software program.

If the LWL assembly (208) is centered in the wellbore (204), it is necessary to determine if a target depth has been reached (S722). In some embodiments, a target depth may refer to a total depth, located at the bottom or end of the wellbore (204) or at the end of the cased part of the wellbore. In other embodiments, a target depth may refer to a location within the wellbore where logging is desirable due to well conditions or other factors. If the target depth has not yet been reached, the LWL assembly (208) may continue to monitor its location within the wellbore (204) (S718), adjusting the levitation force (210) as required to maintain its central location within the wellbore while traversing the wellbore (204) (S720). Once the target depth has been reached, the LWL assembly (208) may facilitate logging while levitating in the center of the wellbore (204) at the target depth (S724).

In one or more embodiments, levitation may be achieved either actively or passively. For active levitation, controllable and adjustable forces are used as levitation forces (210). In one or more embodiments, an electromagnetic force may be used in this manner. For passive levitation, a permanent and predesigned force may be applied, with the source of such a force being mounted on the LWL assembly. In one or more embodiments, such a permanent force may be produced by permanent magnets installed on the LWL assembly (208). In such embodiments, the LWL assembly may be considered to be active at all times as the permanent magnets provide a lifting force opposite to the weight of the tool string and friction.

Figure 8A:
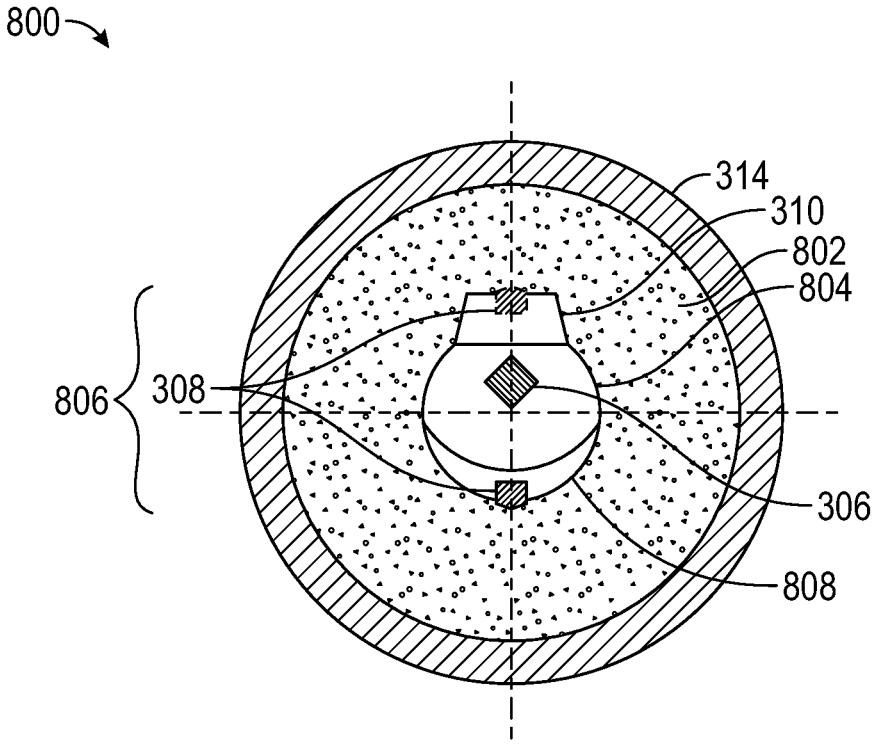
FIGS. 8A-8B show examples in accordance with one or more embodiments.
Figure 8B:
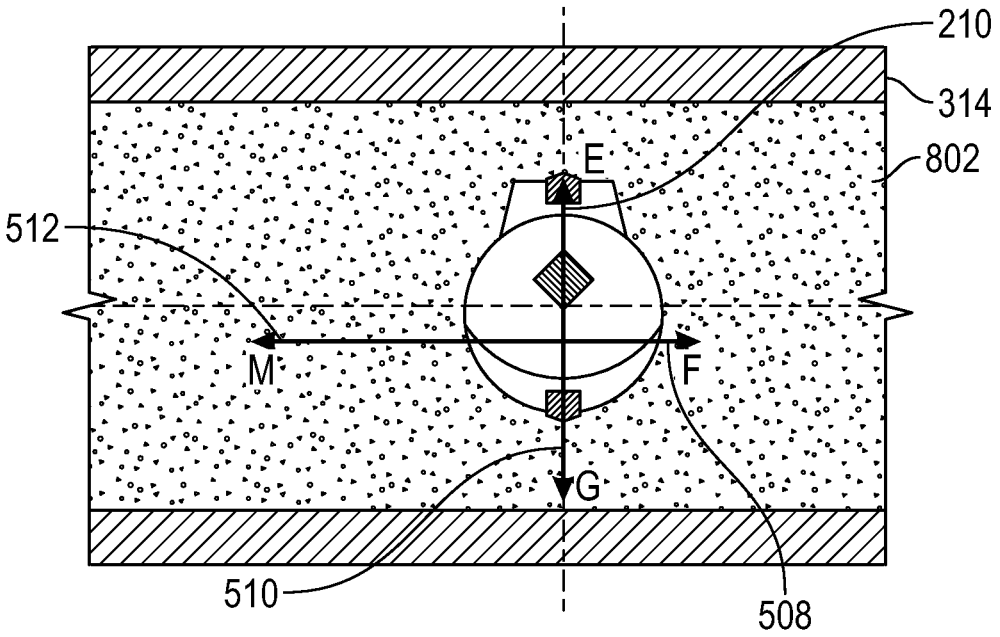

As described above, embodiments of the LWL assembly utilize both tethered conveyance and untethered conveyance. FIGS. 8A and 8B illustrate examples of an untethered LWL assembly (806) in accordance with one or more embodiments. An untethered LWL assembly (806) may be, for example, an autonomous robot that is sent downhole and which is not physically connected to the surface. Turning first to FIG. 8A, FIG. 8A shows a tool body (804) upon which various other components are mounted to make up an untethered LWL assembly (806). One or more proximity sensors (308) may be disposed on a tool body (804), wherein the proximity sensors (308) may be positioned on opposite ends of the tool body (804). One or more tilt sensors (306) may also be disposed upon the tool body (804), with one tilt sensor (306) disposed at the center of the tool body (804).

An orienting weight (808) may be disposed along an edge of the tool body (804) and may be removable. In one or more embodiments, once the untethered LWL assembly (806) has reached a target depth, the orienting weight (808) may be detached from the tool body (804), allowing the tool body (804) and attached sensors to float through the wellbore fluid (802) back to the surface (106) due to a density difference. Detachment of the orienting weight (808) may be controlled from the surface, autonomously, or a combination of both. In some embodiments, controlling detachment from the surface may refer to sending a pressure pulse, chemical, or surface command through the wellbore, for example. An electromagnet (310) may also be mounted on the tool body (804). Though untethered LWL assemblies (806) may be used in any well orientation, including complex well orientations, retrieval of the autonomous device may depend upon the complexity of the well trajectory and available solutions.

In one or more embodiments, the electromagnet (310) may interact with the ferromagnetic casing (314) to create a levitation force (210), as shown in FIG. 8B, which illustrates a longitudinal section view of the untethered LWL assembly (806). The levitation force (210) counters the gravitational force (510) in order to levitate or push the untethered LWL assembly (806) as close to the center of the wellbore as possible. Similarly, the running-in-hole force (512) may act in opposition to the resultant frictional force (510). In one or more embodiments, there may be an absence of ferromagnetic casing (314). In such embodiments, ferromagnetic casing (314) may be replaced by non-magnetic tubing, fiber-glass tubing, coated tubing, non-metallic tubing, or any other type of tubing or downhole environment which does not interact with the electromagnet (310). In these embodiments, the levitation force (210) may be provided by any contactless technique. For example, in some embodiments, thrusters may be used for dynamic positioning. In other embodiments, dynamic positioning may be achieved via the use of powered propellers. Any method of contactless dynamic position may be used without departing from the scope of this disclosure.

Embodiments of the present disclosure may provide at least one of the following advantages. Logging and intervention in complex well profiles present many challenges for conveyance and data quality. Traditional pipe conveyed logging (PCL) or coiled tubing (CT) are prohibitive in terms of rig time, operational complexity and cost. Alternatively, tractor conveyance is limited by the available force in long laterals. Tools and accessories may create higher friction and may jeopardize tool position in the horizontal section. Consequently, both data quality and reaching total depth may be compromised. New techniques to reduce friction and optimize sensor position in the well were introduced recently using wheeled carriages, however these techniques do not completely eliminate friction or perfectly center the tool within the wellbore. Embodiments of the present disclosure introduce a novel deployment technique that eliminates friction, enables both tethered and untethered conveyance in complex well profiles using free fall forces, and provides a solution for shallow lock depth, which is a result of high drag and friction of logging and intervention tools due to contact with the production tubing or casing inner wall. Additionally, due to the lack of friction as a result of the use of embodiments of the present disclosure, conveyance reach is improved, allowing for additional depth to be achieved during logging operations.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112(f) for any limitations of any of the claims herein, except for those in which the claim expressly uses the words 'means for' together with an associated function.

What is claimed is:

1. A method for logging in a cased well, comprising:

receiving well data comprising an orientation of the cased well;

selecting a logging while levitating (LWL) assembly type based on the well data;

running the LWL assembly into the well to a start depth;

activating the LWL assembly based on a downhole condition so that the LWL assembly levitates in a center of the cased well, wherein the activated LWL assembly moves downhole in the cased well while levitating;

wherein levitating comprises contactless hovering in the center of the cased well;

determining whether the LWL assembly has reached a target depth; and performing logging in the cased well while the LWL assembly is levitating in the cased well when the target depth is reached.

2. The method of claim 1, further comprising: inputting the well data into a software program that is configured to determine the LWL assembly type.

3. The method of claim 2, further comprising: determining whether a vertical section LWL assembly is required based on the deviation of the cased well.

4. The method of claim 3, further comprising: employing a double face or a multiple face LWL assembly for the vertical section LWL.

5. The method of claim 1, wherein the orientation of the cased well is a deviation of the cased well.

6. The method of claim 1, further comprising: when the target depth is not reached, increasing or decreasing a lift force of the LWL assembly until the target depth is reached.

7. The method of claim 1, further comprising: attaching the LWL assembly to a logging tool, wherein the LWL assembly is directly connected to the logging tool.

8. The method of claim 7, wherein the logging tool is untethered with a surface of the cased well, the method further comprising:

disconnecting an orienting weight from the logging tool upon reaching the target depth.

9. The method of claim 1, wherein the downhole condition is a predetermined depth in the cased well.

10. An assembly for logging in a cased well, comprising:

an electromagnet; and at least one proximity sensor, wherein the assembly is configured to levitate in a center of the cased well via an electromagnetic force applied by the electromagnet, wherein levitating comprises contactless hovering in the center of the cased well, and wherein the assembly is configured to perform logging while levitating in the cased well.

11. The assembly of claim 10, wherein the assembly is operatively connected to a logging tool configured to perform the logging.

12. The assembly of claim 11, wherein the logging tool is tethered via a conveyance mechanism to a surface of the cased well.

13. The assembly of claim 12, further comprising: a tilt sensor and an orienting wheel.

14. The assembly of claim 10 wherein the assembly is an untethered assembly that autonomously traverses the cased well.

15. The assembly of claim 14, further comprising: an orienting weight operatively connected to the untethered assembly.

16. The assembly of claim 10, wherein the cased well comprising a ferromagnetic casing.

* * * * *